US005152326A

United States Patent [19]

Vöhringer

[11] Patent Number: 5,152,326

[45] Date of Patent: Oct. 6, 1992

[54] BINDING THREAD ARRANGEMENT IN PAPERMAKING WIRE

[75] Inventor: Fritz Vöhringer, Heidenheim, Fed. Rep. of Germany

[73] Assignee: F. Oberdorfer GmbH & Co. KG, Industriegewebe-Technik, Fed. Rep. of Germany

[21] Appl. No.: 613,205

[22] Filed: Nov. 14, 1990

[30] Foreign Application Priority Data

Nov. 16, 1989 [DE] Fed. Rep. of Germany ..... 3938159

[51] Int. Cl.[5] ..... D03D 13/00

[52] U.S. Cl. ..... 139/383 A; 139/410

[58] Field of Search ..... 162/348, DIG. 1; 139/410, 425 R, 383 A

[56] References Cited

U.S. PATENT DOCUMENTS

| | | | |
|---|---|---|---|
| 4,501,303 | 2/1985 | Osterberg | 139/425 A |
| 4,515,853 | 5/1985 | Borel | 139/383 A |
| 4,554,953 | 11/1985 | Borel et al. | 139/383 A |
| 4,832,090 | 5/1989 | Krenkel et al. | 139/383 A |
| 4,867,206 | 9/1989 | Kufferath | 139/383 A |
| 4,945,952 | 8/1990 | Vohringer | 139/383 A |
| 4,974,642 | 12/1990 | Taipale | 139/383 A |

*Primary Examiner*—Andrew M. Falik

*Attorney, Agent, or Firm*—Gifford, Groh, Sprinkle, Patmore and Anderson

[57] ABSTRACT

A composite papermaking fabric including an upper fabric upon which a fiber suspension will be deposited for producing paper and a lower fabric or running surface being driven by the papermaking machine. The upper and lower fabrics are connected by binding threads. Use of separate, independent binding threads or binding threads which are only a part of the upper layer is replaced by the interweaving of fabric-born threads which are an integral part of the lower fabric and fabric-born threads which are an integral part of the upper fabric. Relative slippage between the upper and lower fabric layers is eliminated or decreased and the strength of the connection is increased. The marking of the paper is decreased. The fabric-born threads of one fabric layer cross the fabric-born threads of the other after at least one length of weave pattern.

24 Claims, 4 Drawing Sheets

PRIOR ART

BINDING THREAD ARRANGEMENT IN PAPERMAKING WIRE

BACKGROUND OF THE INVENTION

1. Field of the Invention

This invention relates to a composite papermaking fabric which includes an upper fabric and a lower fabric which are superimposed and connected to one another by binding threads.

2. State of the Prior Art

Composite papermaking fabrics are used on the wet end of papermaking machines for dewatering the fiber suspension which has been deposited on the upper fabric as a slurry as the composite papermaking fabric is introduced into the entrance of the machine. The paper web which is thus formed from the fibers and filling materials of the slurry or pulp is transported through the machine on the composite papermaking fabric which is moved as an endless belt to the press on the papermaking machine.

The composite papermaking fabric not only has to fulfill the basic requirements of dewatering and forming the paper web at the desired rate, but the structure of the fabric must impart to the paper web the desired characteristics of the surface of the paper such as its smoothness and ability to be printed. This in turn is governed by the marking of the paper surface which occurs by the contact with the threads of the upper fabric under the pressure caused by belt or fabric tension which can be fairly great, exceeding 200 Newtons per centimeter. These high tensions also result in high frictional forces causing rapid wear of the lower or running surface of the composite fabric.

Therefore, the advantages and disadvantages of using a one layer fabric versus using a double layer fabric are well known, and even making the choice between a single fabric and a composite fabric, a balance must be struck between producing a paper having an excellent surface quality and maintaining adequate strength in the fabric for long wearing qualities. The finer surface quality of the paper demands fine, thin threads, while wearing and fabric stability require larger diameter wires and a different weave pattern.

While it is apparent that the composite fabric allows the use of a finer wire size and weave pattern for the upper fabric upon which the paper web is formed and the use of coarser wire and fabric for the lower running surface of the composite papermaking fabric, years of development have gone into various ways of interconnecting the upper and lower fabrics by binding warp threads or binding weft threads.

Composite fabrics are already known in which the two fabric layers are interconnected by fabric-born threads of the upper fabric. That is, the interconnecting binding threads are an integral part of the upper fabric. This is shown in European Patent 69 101 and its corresponding U.S. Pat. No. 4,501,303. While this is a significant improvement over the use of independent binding threads, there are fundamental drawbacks with this design. Although the fabric-born binding threads in the upper fabric produce a suitable pattern, they are not simultaneously suited for the lower fabric, thus disturbing the structure of the composite fabric resulting in marking of the paper. Moreover, the binding threads are quickly worn and destroyed because of the relative movement of the two fabrics during its use on the papermaking machine causing friction which in turn results in separation of the two fabric layers from one another. When thicker and more stable binding threads are used to stop the relative movement between the fabric layers, this automatically results in attenuating the marking problem because the thicker the binding threads are, the more the structure of the wire is disturbed.

SUMMARY OF THE INVENTION

It is a primary object of the present invention to provide a composite fabric for use in papermaking machines that has an improved wear resistance with less thread marking of the paper. In accomplishing the foregoing object, the present invention provides a composite papermaking fabric in which the two fabric layers are interconnected in such a way that relative movement between the layers is completely or to a great extent eliminated while keeping the upper fabric from causing marking of the paper.

Inherent in understanding the present invention is the definition of a "fabric-born" thread. Quite simply, a fabric-born thread is a thread which is an integral part of the weave pattern of the fabric in either the weft or warp direction. All of the binding threads used in the present invention are fabric-born threads. Fabric-born binding threads which are an integral part of the upper fabric for at least one length of the upper fabric weave pattern are caused to cross under to become woven in the weave pattern of the lower fabric for at least one length of the lower fabric. Likewise, the fabric-born binding threads which are an integral part of the lower fabric for at least one length of the lower fabric weave pattern are caused to cross over to become woven in the weave pattern of the upper fabric for at least one length of the binding pattern of the upper fabric. The cross over points coincide so that a fabric-born binding thread of the upper fabric is vertically stacked with a fabric-born binding thread of the lower fabric.

Thus the composite papermaking fabric of the present invention includes an upper fabric having an upper weave pattern and a lower fabric having a lower weave pattern superimposed on one another and connected by binding threads which are fabric-born threads forming an integral part of the upper and lower fabric weave patterns. A first binding thread which is interwoven with the cross direction extending threads of the upper fabric for at least one length of the upper fabric weave pattern is vertically stacked over a second binding thread which is interwoven with the cross direction extending threads of the lower fabric for at least one length of the lower fabric weave pattern. The first binding thread is crossed over the second binding thread, and the first binding thread is interwoven with the cross direction extending threads of the lower fabric for at least one length of the lower fabric weave pattern vertically stacked below the second binding thread which interwoven with the cross direction threads of the upper fabric for at least one length of the upper fabric weave pattern.

It is to be understood that the term "fabric-born-threads" as used in the description of the invention means those threads which belong to the fabric instead of threads which are additionally used for a specific purpose, i.e. which do not belong to the structure of the fabric.

In a preferred embodiment of the invention both the upper and lower fabrics are one-layer fabrics. However, one or both of the upper and lower fabrics can consist of more than one layer.

In a preferred embodiment of the invention the fabric-born binding threads connecting the upper and lower fabrics extend parallel to the running direction of the composite papermaking fabric. These binding threads can constitute at least 25% of the total number of threads extending in the running direction of the composite papermaking fabric.

In another embodiment of the invention the fabric-born binding threads connecting the upper fabric to the lower fabric extend transverse to the running direction of the composite papermaking fabric.

In a preferred embodiment of the invention, the upper fabric is woven in linen binding and the lower fabric is formed as a weft runner in a four-shed broken twill binding so that each fourth longitudinal thread of the lower fabric and each fourth longitudinal thread of the upper fabric is an binding thread. In this arrangement, the binding threads which are separated by three interposed longitudinal threads of the upper fabric or the lower fabric are offset with respect to one another by four cross threads of the upper fabric or the lower fabric respectively.

In other preferred embodiments, the number of binding threads constitute at least 10% of the total number of threads in the same direction.

The binding threads in the upper and lower fabrics can simultaneously extend in the running direction of the composite papermaking fabric and in a direction transverse to the running direction of the composite papermaking fabric.

In all of the foregoing embodiments, the structural cohesion of the binding threads in both the upper and lower fabrics are at least identical to that of the longitudinally directed threads with respect to the transversely directed threads of each of the two layers. Thus it follows that the relative movement between the upper and lower fabrics which are interconnected with one another cannot be greater than the relative movement between the interwoven longitudinal and cross threads of the two single fabric layers. Thus this relative movement has been diminished to such an extent that it is of no concern.

The foregoing advantages of the invention have been obtained without making the weaving and seaming more expensive than it is for the manufacture of double layered fabrics provided with two layers of cross threads but with only one layer of longitudinal threads.

BRIEF DESCRIPTION OF THE DRAWINGS

The advantages of the present invention will be more apparent from the following detailed description when considered in connection with the accompanying drawing wherein.

DETAILED DESCRIPTION OF THE PREFERRED EMBODIMENT OF THE INVENTION

Figure 1:
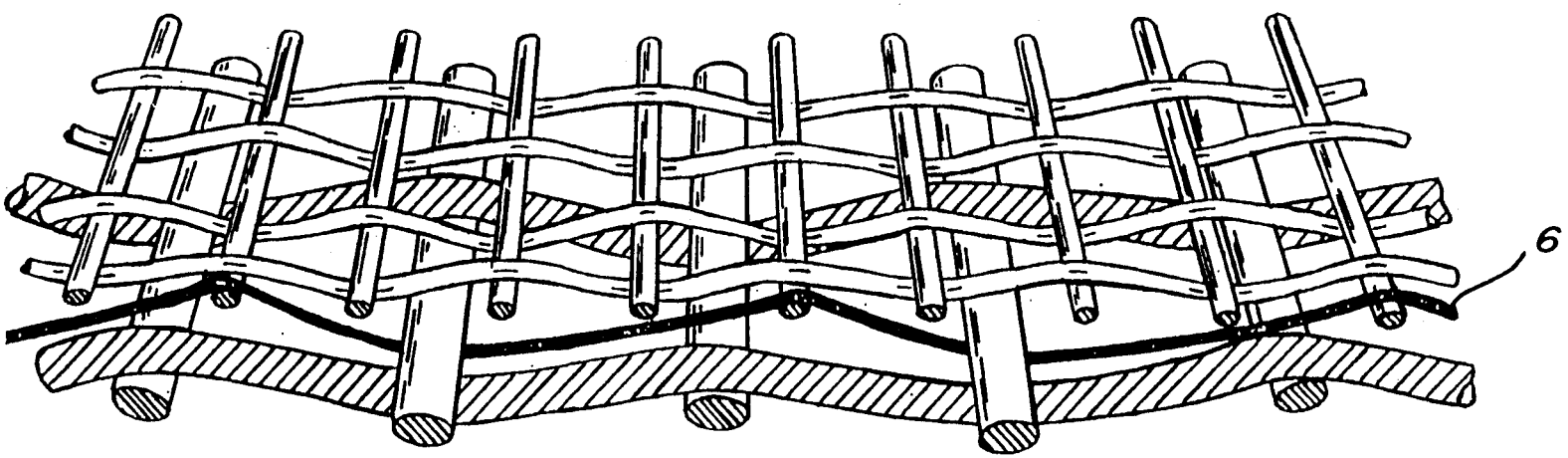
FIG. 1 is a perspective longitudinal section of a composite fabric according to the prior art.

Comparison of the prior art fabric shown in FIG. 1 with the fabrics shown in FIGS. 2–5 reveals the distinction between the prior art technique of joining the upper and lower fabrics with separate binding threads and the binding technique according to the invention using only fabric-born binding threads. As can be seen in FIG. 1, the separate binding thread 6 forms no distinctive configured connection between the upper fabric and the lower fabric which is the reason that such a connection allows substantial relative movements between the two fabrics resulting in quick destruction of the composite fabric.

The composite fabrics of FIGS. 2–5, in contrast to the prior art fabric of FIG. 1, are woven in according to the principles of the present invention wherein the binding threads are fabric-born threads which are an integral part of the upper and lower fabrics so that the structural cohesion is not any less than the structural cohesion of the thread system itself, i.e. the cohesion is not less than the natural cohesion of the longitudinally directed threads to the cross directed threads of the individual upper and lower fabric patterns. Thus the movement of the upper fabric with respect to the lower fabric has been minimized to an extent that it substantially does not exist, eliminating the frictional and breaking problems associated with the prior art. Also the strength of the connection between the upper and lower fabrics is greatly increased increasing the overall integrity of the composite fabric and its life.

Figure 2A:
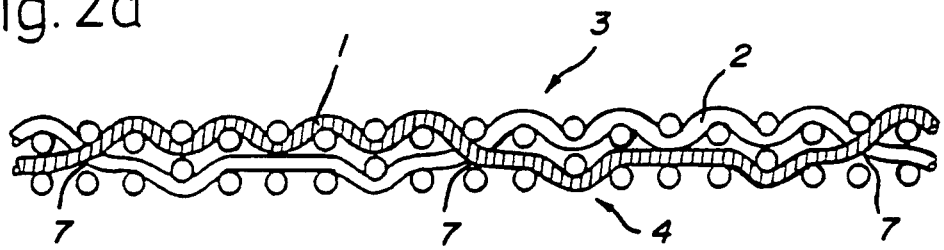
FIG. 2*a* is a longitudinal section of a composite fabric according to the invention showing two fabric-born binding threads woven into the upper fabric and the lower fabric, both binding threads extending in the longitudinal or machine direction.
Figure 2B:
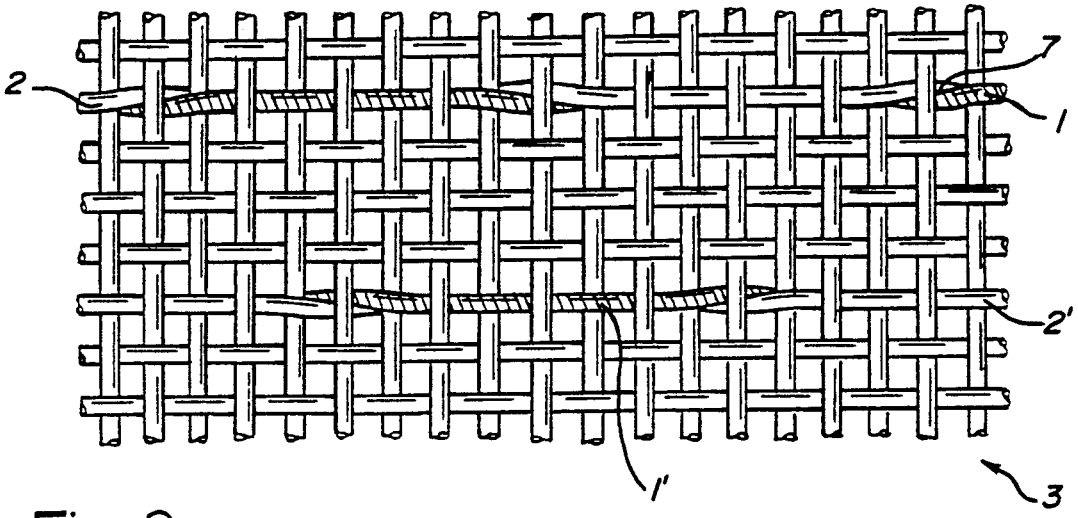
FIG. 2*b* is a plan view of the upper surface of the upper fabric of the composite fabric of FIG. 2*a* which is exposed to the paper, showing the fabric-born binding threads crossing over from the upper fabric to the lower fabric and crossing over from the lower fabric to the upper fabric.
Figure 2C:
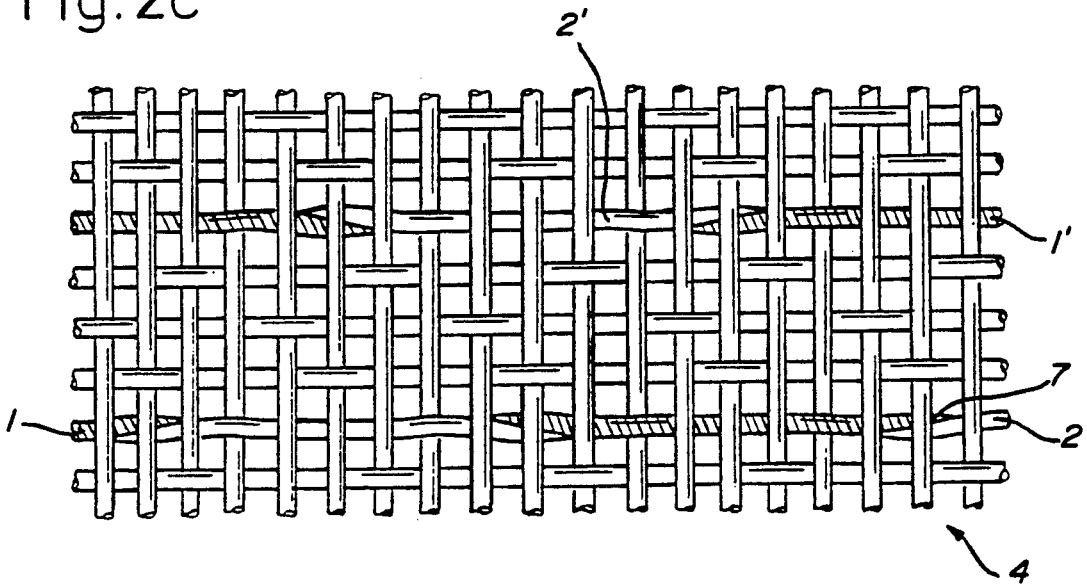
FIG. 2*c* is a plan view of the lower surface of the lower fabric of the composite fabric of FIG. 2*a* showing the fabric-born binding threads crossing over from the lower fabric to the upper fabric and from the upper fabric to the lower fabric.

The composite fabric according to the invention which is shown in FIGS. 2*a*–2*c* is provided with an upper fabric woven in a linen binding, as better seen in FIGS. 2*a* and 2*b*, and is provided with a lower fabric 4 which is formed as a 4-shed broken twill binding provided as a weft runner as seen in FIGS. 2*a* and 2*c*. Each fourth longitudinal thread of the lower fabric 4 and each fourth longitudinal thread of the upper fabric 3 is a binding thread 1, 1' and 2, 2', respectively. There is, a first binding thread 1, 1', which runs longitudinally, or in the machine direction, and is interwoven with the threads of the upper fabric 3 which extend in a cross direction, or in a direction transverse to the running direction, within the weave pattern of that fabric over at least a length of one pattern repeat. A second fabric-born binding thread 2, 2' which runs longitudinally, or in the machine direction, and is interwoven with the threads of the fabric pattern, of the lower fabric 4 which extend in a cross direction or in a transverse direction within the weave pattern of this lower fabric over at least one length of the pattern repeat. As seen in FIGS. 2*b* and 2*c* the first binding thread 1, 1' of the upper fabric and the second binding thread 2, 2' of the lower fabric cross over each other so that the first binding thread 1, 1' is interwoven with the threads of the lower fabric 4 extending in the cross or transverse direction, and the second thread 2, 2' of the lower fabric is interwoven with the threads of the upper fabric 3 extending in the cross or transverse direction, both within their respective weave patterns over at least one length of pattern repeat. As can be easily seen in FIGS. 2*b* and 2*c*, binding threads 1 and 2 are vertically stacked, and binding threads 1' and 2' are vertically stacked, crossing over each other at the point 7. This crossing over of the first threads 1, 1' and the second binding threads 2, 2' is continuously repeated.

The binding threads 1, 2; 1', 2', of the upper fabric and the lower fabric are separated from one another by three longitudinal threads arranged between them. They are also offset with respect to one another by four cross threads of the upper fabric or lower fabric, respectively, in order to obtain a distribution of the crossing points 7 as favorably as possible within the composite fabric.

Figure 3:
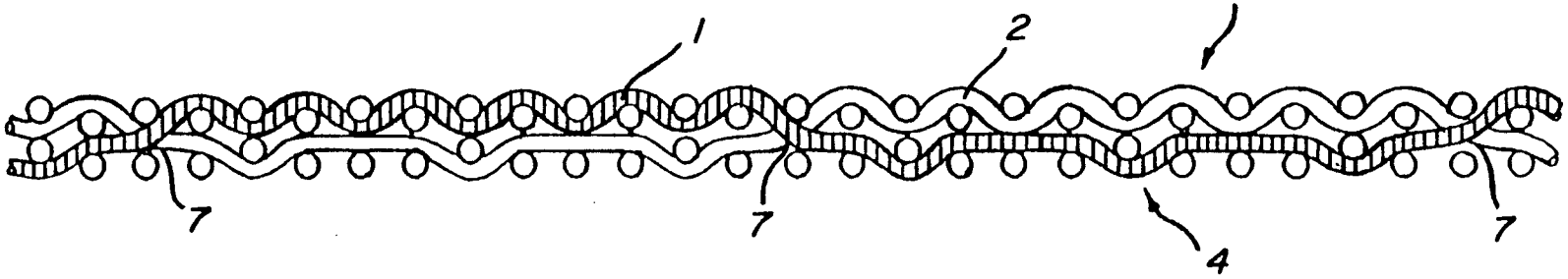
FIG. 3 is a longitudinal section along two binding threads which are interwoven with the lower fabric over two complete weave patterns within the binding pattern of the lower fabric corresponding to the fabric shown in FIG. 2*c;*
Figure 4:
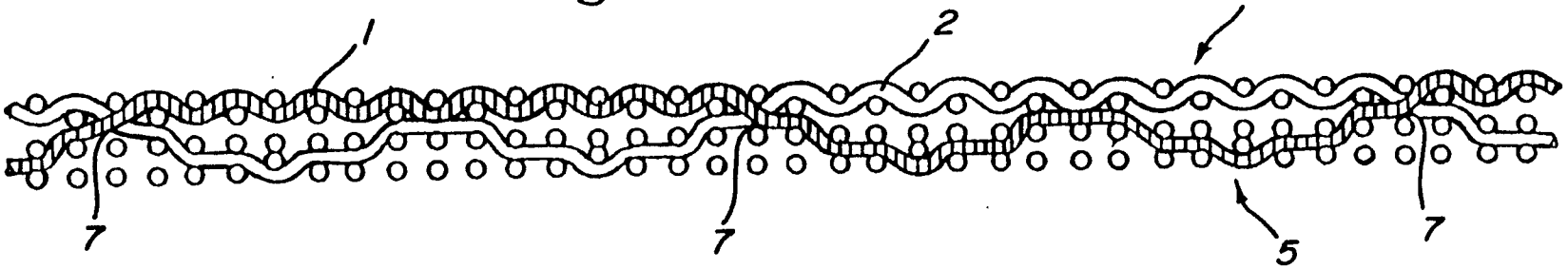
FIG. 4 is a longitudinal section of a one-layer upper fabric and a double-layer lower fabric of a composite fabric according to the invention along two binding threads.

In FIG. 3, the composite fabric is formed with the two binding threads 1 and 2 interwoven in the lower fabric over two successive complete pattern repeats of the weave pattern of the lower fabric. Using two successive pattern repeats before cross over to the upper fabric allows the crossing points 7 to be arranged at greater distances from one another than using only one pattern repeat before cross over. With such a spacing it is possible, if necessary, to weave into the fabric a greater number of binding threads. Thus, in an extreme case all of the threads of a given thread direction can be binding threads within the meaning of the invention. For many applications it is sufficient if the number of binding threads are at least 10% of the threads extending in the same direction. In this regard it should appreciated that the binding threads 1, 1' and 2, 2' can extend parallel to the longitudinal or running direction of the paper as shown in FIG. 2, or they can extend transverse to the running direction as shown and will be described in FIG. 5. Also the combination of transverse and longitudinally extending binding threads is possible and practical, although such a combination is not illustrated as such.

It has been found particularly advantageous to use at least 25% of the threads extending parallel to the running direction of the paper machine as binding threads of the type depicted in the drawing by the refernce numerals 1, 1', or 2, 2', respectively.

Although the embodiments of the composite fabric shown in FIGS. 2*a* to 2*c* and 3 are shown as one layer of fabric for both the upper fabric 3 and the lower fabric 4, the invention embraces composite fabrics in which at least one of the upper and lower fabrics has more than one layer. Such is the case presented in FIG. 4 wherein the lower fabric is shown as a double-layer 8-shed fabric in which the warp threads in the pattern are offset with respect to one another by an offset number of three or five. This defines the weave pattern of the lower fabric 5. The pattern repeat of the warp threads can be seen in FIG. 4. The upper fabric of the FIG. 4 embodiment is woven in the linen binding pattern of FIG. 2.

According to the specific embodiments of the composite wire shown in FIGS. 2*a* to 2*c*, the papermaking composite fabric consists of the following components in which the term "cross" corresponds to a direction transverse to the longitudinal thread.

| | |
|---|---|
| Upper Fabric (Forming Fabric) | |
| Weave Pattern: | Linen binding |
| Number of longitudinal threads: | 30 per cm |
| Diameter of the longitudinal threads: | 0.17 cm |
| Material of the longitudinal threads: | Polyester |
| Number of cross threads: | 26 per cm |
| Diameter of the cross threads: | 0.17 cm |
| Material of the cross threads: | Polyester |
| Lower Fabric (Wearing Fabric and Stabilizing Fabric) | |
| Weave pattern: | 4-shed broken twill |
| Number of longitudinal threads: | 30 per cm |
| Diameter of the longitudinal threads: | 0.17 CM |
| Material of the longitudinal threads: | Polyester |
| Number of cross threads: | 26 per cm |
| Diameter of the cross threads: | 0.25/0.25 mm |
| Material of the cross threads: | Polyester<br>Polyamide |

Figure 5A:
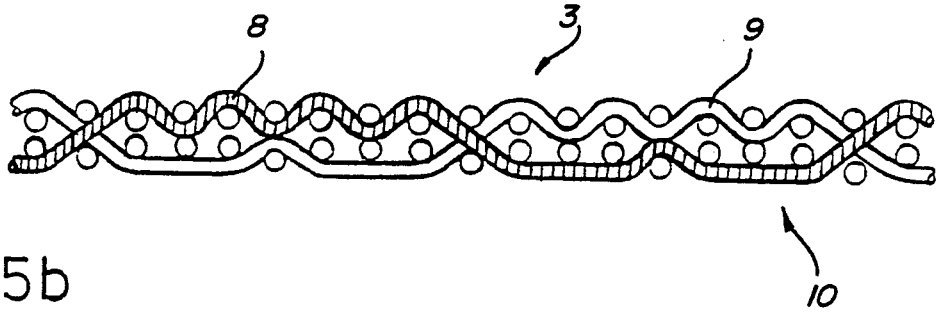
FIG. 5*a* is a transverse section of a composite fabric according to the invention showing two fabric-born binding threads woven within the upper fabric and lower fabric both binding threads extending in a direction transverse to the longitudinal or machine direction.
Figure 5B:
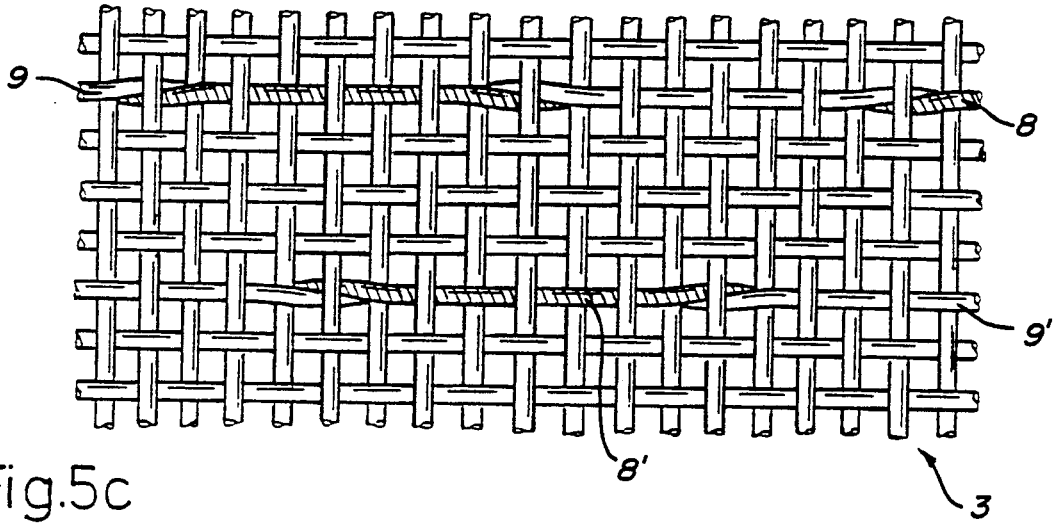
FIG. 5*b* is a plan view of the upper side of the upper fabric of the composite fabric of FIG. 5*a* exposed to the paper, showing fabric-born binding threads of the upper fabric crossing over to the lower fabric and fabric-born binding threads of the lower fabric crossing over to the upper fabric.

The composite papermaking fabric of FIG. 5*a* is one in which the fabric-born binding threads 8 and 9 extend in a direction transverse to the running direction of the papermaking machine. These binding threads 8 and 9 join the upper fabric 3 with the lower fabric 10. As seen in FIG. 5*b* in plan, the upper fabric 3 is shown in a linen-binding pattern with the cross threads 8, 8' and 9, 9' joining this upper fabric with the lower fabric. The threads 8 and 9 cross each other at the same point as do the binding threads 8' and 9'. Otherwise, the details of the fabric and its variations are the same as those described in the description of the longitudinal binding threads shown in FIGS. 2*a* and 2*b*.

Figure 5C:
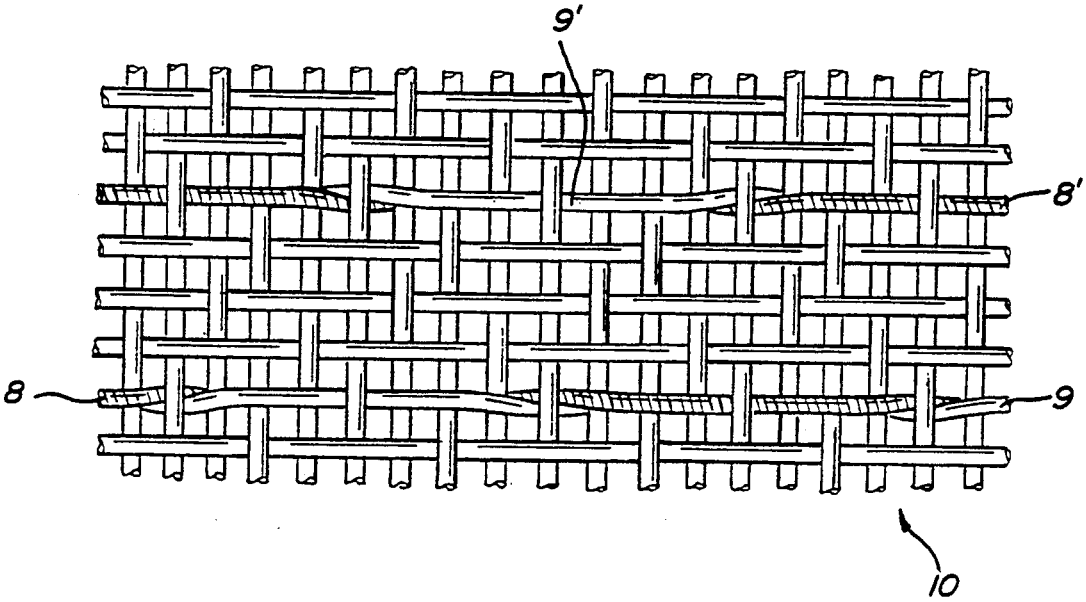
FIG. 5*c* is a plan view of the lower surface of the lower fabric of the composite fabric of FIG. 5*a* showing the arragement of the fabric born binding threads within the lower fabric crossing over to the upper fabric and the binding threads crossing over from the upper fabric to the lower fabric.

FIG. 5*c* is also a plan view but showing the lower fabric 10 of the composite fabric of FIG. 5*a*. Here the lower fabric is woven in a 4-shed broken twill binding pattern. The connecting threads 8, 8' and 9, 9' extend transversely to the running direction of the composite wire floating over three longitudinal threads, crossing a longitudinal thread below its underside surface and then floating once more over three longitudinal threads before it is allowed to cross over and extend into the upper fabric in which they are combined with the longitudinal thread in the linen-binding.

As previously stated, the binding threads can extend in the running direction of the composite fabric as shown by threads 1, 1' and 2, 2' in FIGS. 2*a*, 2*b* and 2*c*, or the binding threads can extend in a direction transverse to the running direction as shown by threads 8, 8' and 9, 9' presented in FIGS. 5*a*, 5*b* and 5*c*. Binding threads may also run in both mutually perpendicular directions.

The composite fabrics according to this ivention can be woven flat as well as round. In the case of the flat weaving, the warp threads are the longitudinal threads and the composite fabric is made into an endless belt by a seam. In the case of the round weaving, the weft threads are the longitudinal threads or circumferential threads of a fabric tube.

While this invention has been particularly shown and described with reference to the specific designs in FIGS. 2–5, it will understood by those skilled in the art that the scope of the invention is not so limited, but extends naturally to a multiplicity of kinds of fabrics with different repeat patterns and number of layers in both the upper and lower fabrics without departing from the spirit and scope of the invention.

I claim:

1. A composite papermaking fabric comprising an upper fabric having an upper weave pattern and a lower fabric having a lower weave pattern superimposed on one another and connected by binding threads which are fabric-born threads forming an integral part of the upper and lower fabric weave patterns, wherein a first binding thread which is interwoven with cross direction extending threads of the upper fabric for at least one length of the upper fabric weave pattern is vertically stacked over a second binding thread which is interwoven with cross direction extending threads of the lower fabric for at least one length of the lower fabric weave pattern, and said first binding thread is crossed over said second binding thread, and said first binding thread is interwoven with the cross direction extending threads of the lower fabric for at least one length of the lower fabric weave pattern vertically stacked below said second binding thread which is interwoven with the cross direction threads of the upper fabric for at least one length of the upper fabric weave pattern.

2. The composite papermaking fabric according to claim 1 wherein said upper fabric and said lower fabric are one-layer fabrics.

3. The composite papermaking fabric according to claim 2, wherein said fabric-born first and second binding threads connecting said upper fabric to said lower fabric extend parallel to a running direction of the composite papermaking fabric.

4. The composite papermaking fabric according to claim 2, wherein said fabric-born first and second binding threads connecting said upper fabric to said lower fabric extend transverse to a running direction of the composite papermaking fabric.

5. The composite papermaking fabric according to claim 4, wherein the number of the binding threads constitute at least 10% of the total number of threads running in the same direction.

6. The composite papermaking fabric according to claim 2, wherein the number of the binding threads constitute at least 10% of the total number of threads running in the same direction.

7. The composite papermaking fabric according to claim 3, wherein the number of the binding threads constitute at least 10% of the total number of threads running in the same direction.

8. The composite papermaking fabric according to claim 1 wherein at least one of the upper and lower fabrics consists of more than one layer.

9. The composite papermaking fabric according to claim 8 wherein said fabric-born first and second binding threads connecting said upper fabric to said lower fabric extend parallel to a running direction of the composite papermaking fabric.

10. The composite papermaking fabric according to claim 8, wherein said fabric-born first and second binding threads connecting said upper fabric to said lower fabric extend transverse to a running direction of the papermaking fabric.

11. The composite papermaking fabric according to claim 10, wherein the number of the binding threads constitute at least 10% of the total number of threads running in the same direction.

12. The composite papermaking fabric according to claim 8, wherein the number of the binding threads constitute at least 10% of the total number of threads running in the same direction.

13. The composite papermaking fabric according to claim 9, wherein the number of the binding threads constitute at least 10% of the total number of threads running in the same direction.

14. The composite papermaking fabric according to claim 1 wherein said fabric-born first and second binding threads connecting said upper fabric to said lower fabric extend parallel to a running direction of the composite papermaking fabric.

15. The composite papermaking fabric according to claim 14, wherein said first and second binding threads extending parallel to the running direction of the composite papermaking fabric constitute at least 25% of the total number of threads extending in the running direction of the papermaking wires in said upper and lower fabrics.

16. The composite papermaking fabric according to claim 14, wherein the number of the binding threads constitute at least 10% of the total number of threads running in the same direction.

17. A composite wire according to claim 15, characterized in that the number of the binding threads constitute at least 10% of the total number of threads running in the same direction.

18. The composite papermaking fabric according to claim 1 wherein said fabric-born first and second binding threads connecting said upper fabric to said lower fabric extend transverse to a running direction of the composite papermaking fabric.

19. The composite papermaking fabric according to claim 18, wherein the number of the binding threads constitute at least 10% of the total number of threads running in the same direction.

20. The composite papermaking fabric according to claim 1 wherein said upper fabric is woven in linen binding and said lower fabric is formed as weft runner in a four-shed broken twill binding so that each fourth longitudinal thread of the lower fabrics and each fourth longitudinal thread of the upper fabric is a binding thread.

21. A composite wire according to claim 20, characterized in that the number of the binding threads constitute at least 10% of the total number of threads running in the same direction.

22. The composite papermaking fabric according to claim 20, wherein the binding threads which are separated by three interposed longitudinal threads of the upper fabric or lower fabric, respectively, are offset with respect to one another by four cross threads of the upper fabric or lower fabric, respectively.

23. A composite wire according to claim 22, characterized in that the number of the binding threads constitute at least 10% of the total number of threads running in the same direction.

24. The composite papermaking fabric according to claim 1 wherein the number of the binding threads constitute at least 10% of the total number of threads running in the same direction.

* * * * *